US009969183B2

(12) United States Patent
Toussaint et al.

(10) Patent No.: US 9,969,183 B2
(45) Date of Patent: May 15, 2018

(54) SELECTIVELY HEATING A HEATING ZONE OF A PRINTING SYSTEM

(71) Applicant: Hewlett-Packard Development Company, L.P., Houston, TX (US)

(72) Inventors: David Toussaint, Barcelona (ES); Oriol Borrell Avila, Sabadell (ES); Francisco Javier Rodriguez Escanuela, Mataro (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days. days.

(21) Appl. No.: 15/022,528

(22) PCT Filed: Sep. 19, 2013

(86) PCT No.: PCT/US2013/060689
§ 371 (c)(1),
(2) Date: Mar. 16, 2016

(87) PCT Pub. No.: WO2015/041657
PCT Pub. Date: Mar. 26, 2015

(65) Prior Publication Data

US 2016/0236485 A1 Aug. 18, 2016

(51) Int. Cl.
*B41J 11/00* (2006.01)
*B41J 2/01* (2006.01)

(52) U.S. Cl.
CPC ..... *B41J 11/002* (2013.01); *B41J 2/01* (2013.01)

(58) Field of Classification Search
CPC ..... B41J 11/002; B41J 2/01
See application file for complete search history.

(56) References Cited

U.S. PATENT DOCUMENTS

| | | | |
|---|---|---|---|
| 5,212,498 | A | 5/1993 | Sugimori |
| 6,286,926 | B1 | 9/2001 | Hirabayashi et al. |
| 6,398,333 | B1 | 6/2002 | Mulay et al. |
| 6,836,626 | B2 | 12/2004 | Hooper et al. |
| 6,868,623 | B2 | 3/2005 | Bjornberg |

(Continued)

FOREIGN PATENT DOCUMENTS

| | | |
|---|---|---|
| EP | 0771661 | 5/1997 |
| JP | 03151239 | 6/1991 |

OTHER PUBLICATIONS

European Patent Office, Communication—Supplementary European Search Report for Appl. No. 13893696.8 dated Feb. 20, 2017 (4 pages).

(Continued)

*Primary Examiner* — Henok Legesse
(74) *Attorney, Agent, or Firm* — HP Inc. Patent Department

(57) ABSTRACT

A method includes identifying at least one of a type of a respective media to be printed on in the print zone and respective densities of portions of the image by an identification module. The method also includes independently adjusting a respective target curing temperature of each one of a plurality of heating modules disposed across the media transport path in a first direction to form the heating zone based on the at least one of the type of the respective media and the respective densities of the portions of the image identified by the identification module by a temperature adjustment module.

18 Claims, 6 Drawing Sheets

(56) References Cited

U.S. PATENT DOCUMENTS

| | | | | |
|---|---|---|---|---|
| 7,303,273 | B2 | 12/2007 | Jurrens et al. | |
| 7,578,629 | B2 * | 8/2009 | Kruijt | B41J 11/0025 248/363 |
| 8,293,035 | B2 | 10/2012 | Zurecki et al. | |
| 8,327,762 | B2 | 12/2012 | Masuch et al. | |
| 2002/0067403 | A1 * | 6/2002 | Smith | B41J 11/007 347/104 |
| 2006/0158507 | A1 | 7/2006 | Naito | |
| 2008/0204537 | A1 | 8/2008 | Suzuki | |
| 2012/0147080 | A1 | 6/2012 | Kodaira | |
| 2012/0206527 | A1 | 8/2012 | Leighton et al. | |
| 2012/0287196 | A1 * | 11/2012 | Boland | B41J 11/002 347/16 |

OTHER PUBLICATIONS

PCT International Search Report and Written Opinion, dated Jun. 13, 2014, PCT Application No. PCT/US2013/060689, Korean Intellectual Property Office, 15 pages.

Roll-to-roll Printing, (Web Page), Nov. 27, 2012. Available at: <http://industrial-printing.net/content/roll-roll-printing-0#.Vubtj-lrLmE >.

* cited by examiner

SELECTIVELY HEATING A HEATING ZONE OF A PRINTING SYSTEM

CROSS-REFERENCE TO RELATED APPLICATION

This application is a U.S. National Stage Application of and claims priority to International Patent Application No. PCT/US2013/060689, filed on Sep. 19, 2013, and entitled "SELECTIVELY HEATING A HEATING ZONE OF A PRINTING SYSTEM," which is hereby incorporated by reference in its entirety.

BACKGROUND

Printing systems form images on media. Printing systems such as large format printers include heating systems. The heating systems may provide uniform heat in the print zone to assist image formation on the media.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printing systems form images on media. Printing systems such as large format printers include heating systems. The heating system may uniformly provide heat of substantially the same temperature to a testing zone to assist image formation on the media. Thus, activation of the heating assembly may provide an entire print zone with substantially the same temperature. Portions of the image printed on media requiring different target curing temperatures, however, may not be efficiently and/or properly addressed. Additionally, simultaneously heating a print zone having multiple media present at the same time requiring different target curing temperatures may not be efficiently and properly addressed.

In examples, a method of printing of a printing system includes, amongst other things, identifying at least one of a type of a respective media to be printed on in a print zone and respective densities of portions of the image by an identification module. The method also includes independently adjusting a respective target curing temperature of each one of a plurality of heating modules disposed across the media transport path in a first direction to form the heating zone based on the at least one of the type of the respective media and the respective densities of the portions of the image identified by the identification module by a temperature adjustment module. Thus, independently adjusting a respective target curing temperature of each one of a plurality of heating modules by the temperature adjustment module based on a resultant identification by the identification module may efficiently and sufficiently heal portions of the image printed on media requiring different target curing temperatures. Additionally, simultaneously heating multiple media present at the same time in the print zone requiring different target curing temperatures may be accomplished in an efficient and proper manner.

Figure 1:
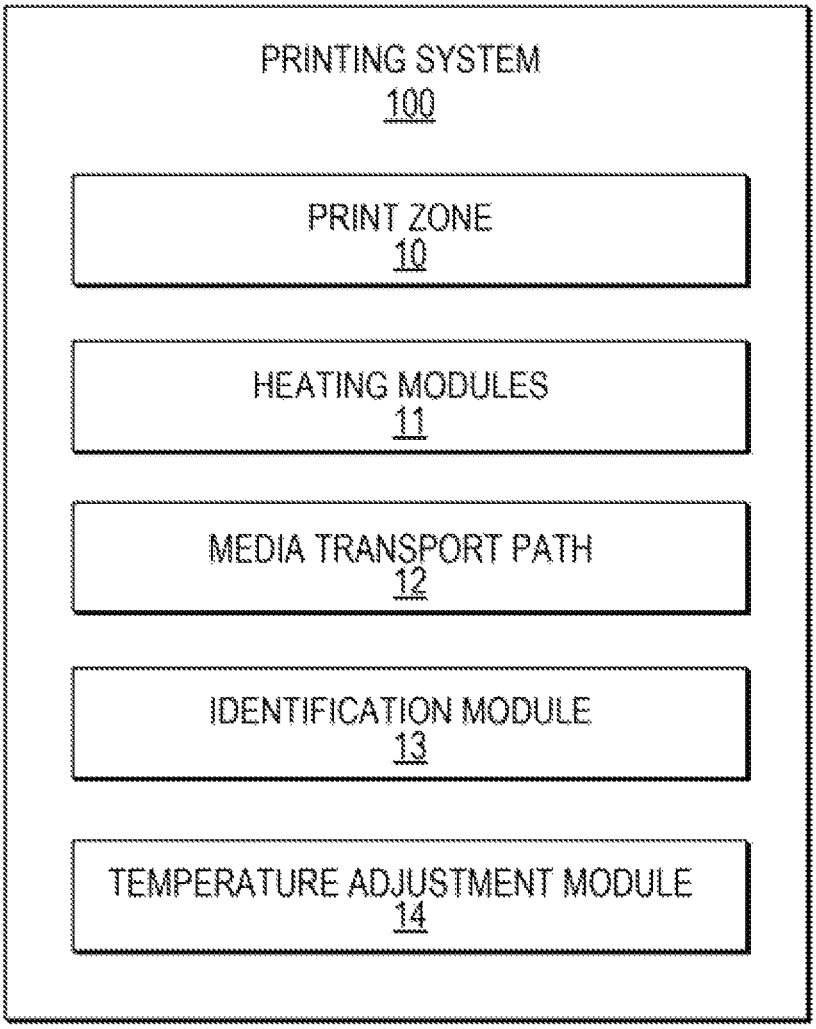
FIG. 1 is a block diagram illustrating a printing system according to an example.

FIG. 1 is a block diagram illustrating a printing system according to an example, Referring to FIG. 1, in some examples, a printing system 100 includes a print zone 10, a plurality of heating modules 11, a media transport path 12, an identification module 13, and a temperature adjustment module 14. The print zone 10 may be an area adjacent to a portion of the media transport path 12 to receive media to be printed on therein. For example, the print zone 10 may be adjacent to an area between and adjacent to a printing fluid applicator and a portion of the media transport path 12 on which media therein may be printed. The plurality of heating modules 11 may be disposed across a heating zone in a first direction such as a printing fluid scanning direction. Each one the plurality of heating modules 11 may selectively provide heat having a respective target curing temperature in the heating zone, in some examples, the heating modules 11 may include impinging curing modules, and the like.

Referring to FIG. 1, in soma examples, the media transport path 12 along which a respective media is transported by a media transport assembly 27 (FIG. 2) may be disposed through the print zone 10 in a second direction and the heating zone. For example, the media transport assembly 27 may include moving rollers, belts, and/or media support members to move media to and from the print zone 10 and to and from the heating zone. The identification module 13 may identify at least one of a type of the respective media to be printed on in the print zone 10 and respective densities of portions of the image. For example, types of media may include paper, cardboard, fabric, vinyl, plastic, and the like.

In some examples, the identification module 13 may identify the respective densities of the portions of the image from image data prior to printing the image on the respective media. The identification module 13 may identity and store respective densities of image portions in a bi-dimensional array. The image data may be stored in memory. Alternatively, the identification module 13 may identify the respective densities of the portions of the image may be performed after printing the image on the respective media. The temperature adjustment module 14 may independently adjust a respective target curing temperature of each one of the heating modules 11 based on at least one of the type of the respective media and the respective densities of the portions of the image identified by the identification module 13.

In some examples, the identification module 13 and/or temperature adjustment module 14 may be implemented in hardware, software including firmware, or combinations thereof. The firmware, for example, may be stored in memory and executed by a suitable instruction-execution system. If implemented in hardware, as in an alternative, example, the identification module 13 and/or temperature adjustment module 14 may be implemented with any or a combination of technologies which are well known in the art (for example, discrete-logic circuits, application-specific integrated circuits (ASICs), programmable-gate arrays (PGAs), field-programmable gate arrays (FPGAs)), and/or other later developed technologies. In some examples, the identification module 13 and/or temperature adjustment module 14 may be implemented in a combination of software and data executed and stored under the control of a computing device.

Figure 2:
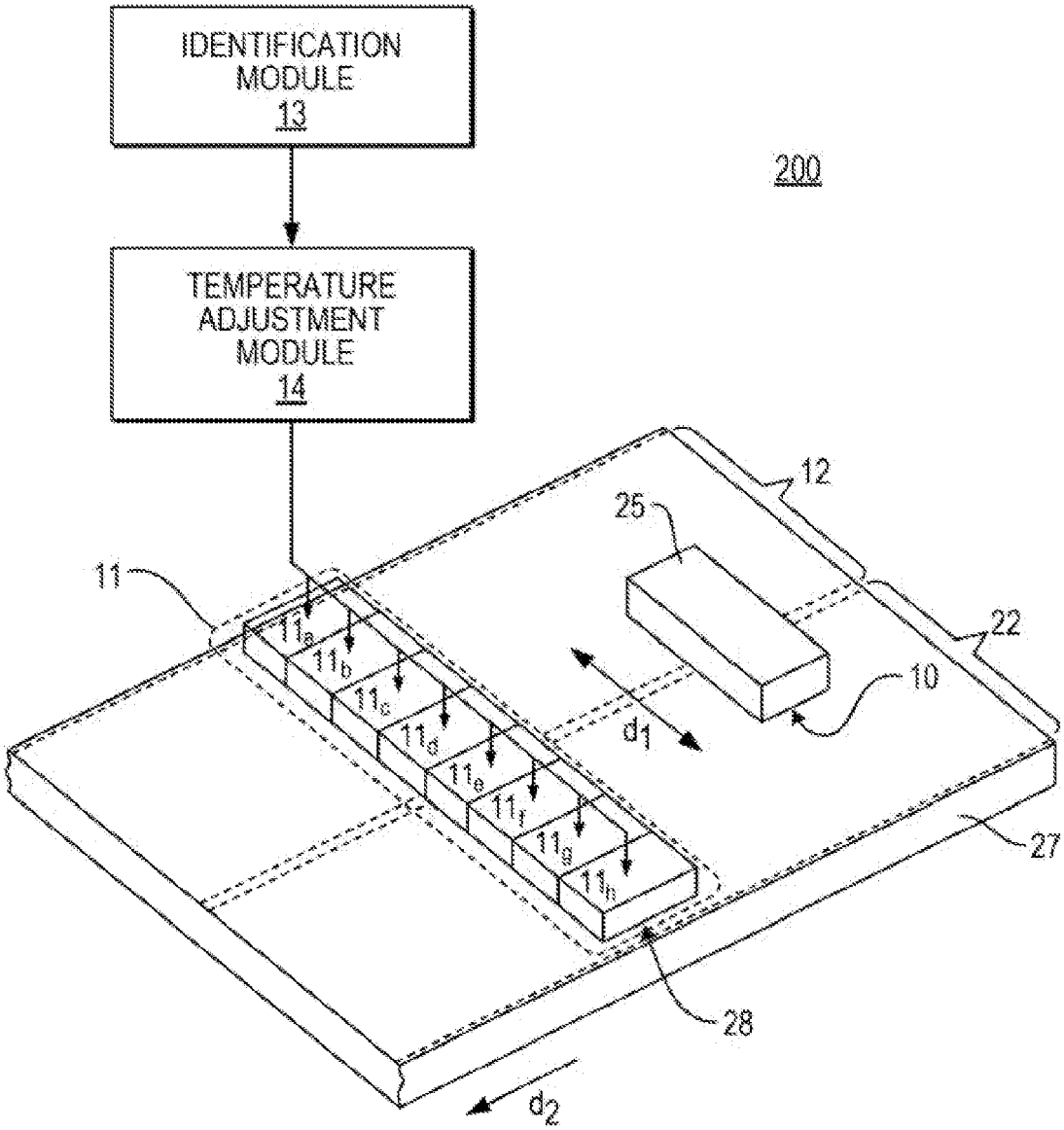
FIG. 2 is a schematic view illustrating a printing system according to an example.
Figure 3B:
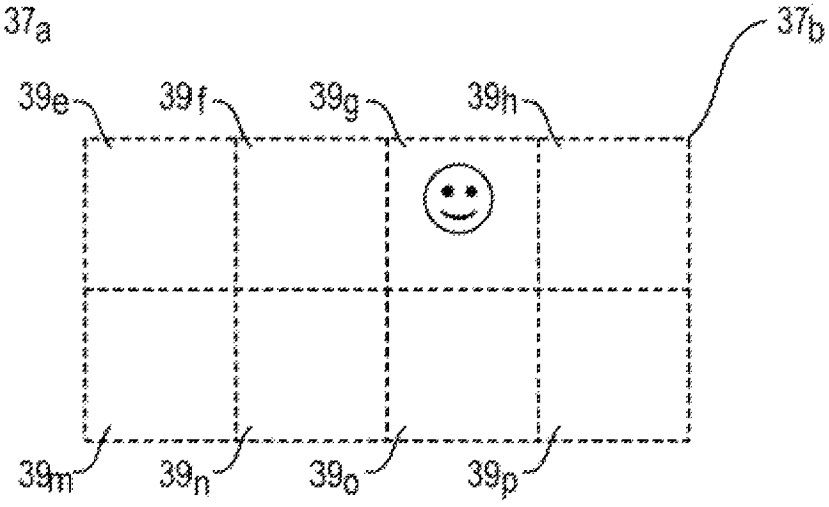
FIGS. 3A and 3B are representational views of image data in memory corresponding to respective images to be printed by the printing system of FIG. 2 according to examples.
Figure 3A:
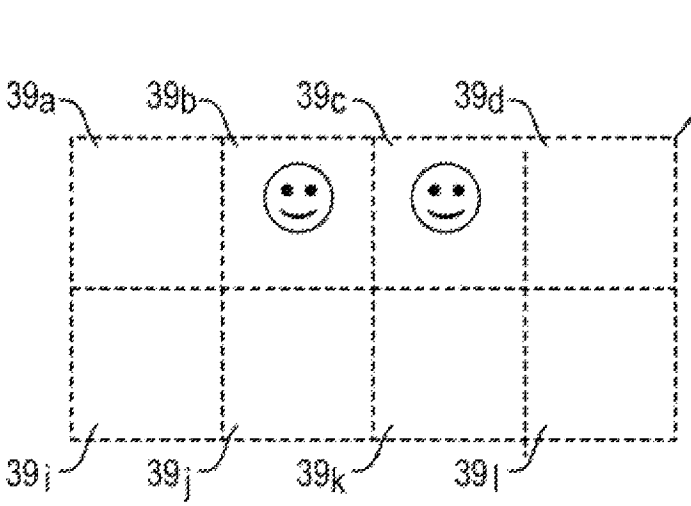
Figure 4:
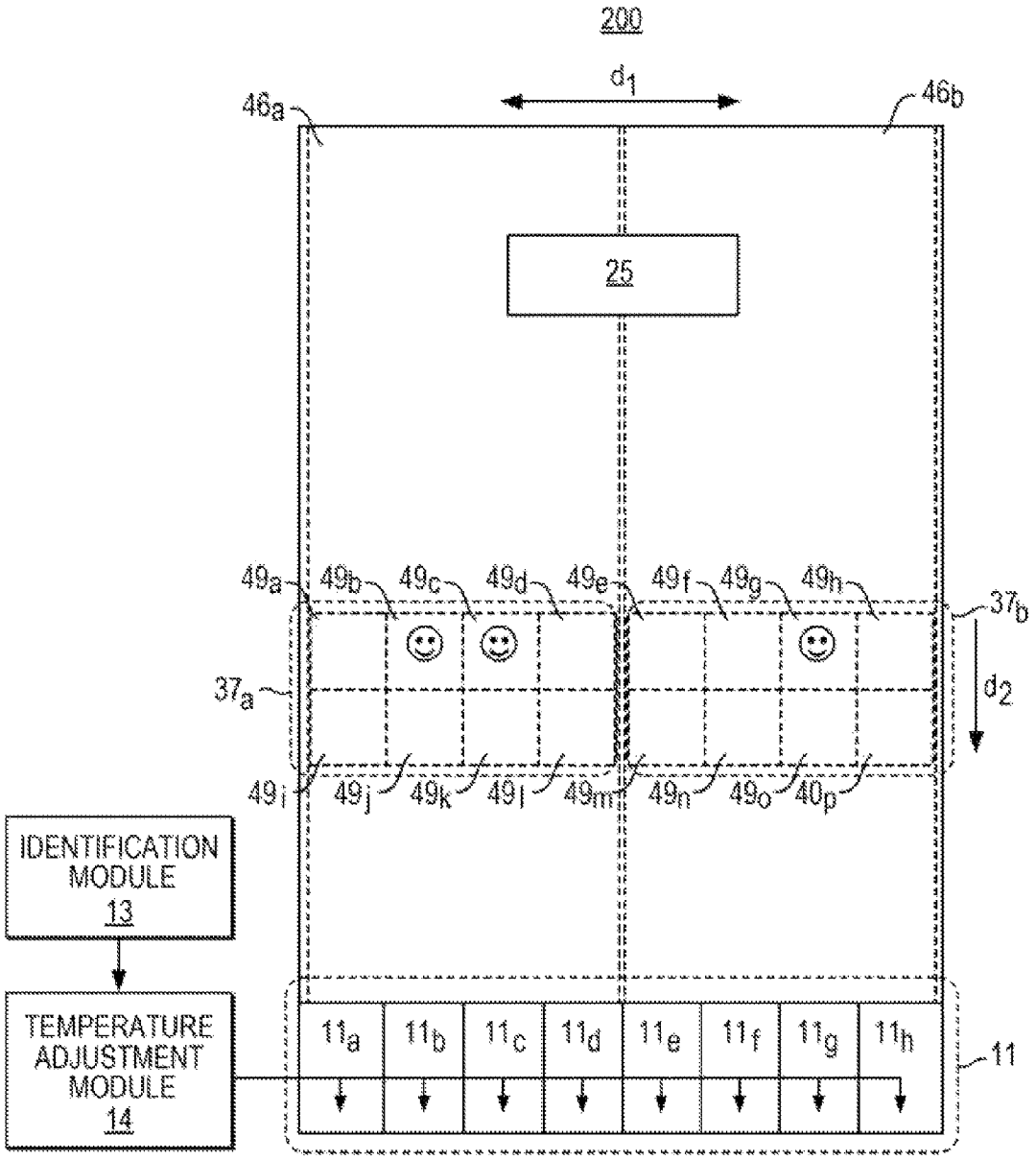
FIG. 4 as a schematic top view illustrating a printing system including heating modules to heat images on media according to an example.

FIG. 2 is a schematic view illustrating a printing system according to an example. FIGS. 3A and 3B ere representational views of image data in memory corresponding/to respective images to be printed by the printing system of FIG. 2 according to examples. FIG. 4 is a schematic top view illustrating a printing system including healing modules to heat images on media according to an example. Referring to FIGS. 2-4, in some examples, a printing system 200 may include the print zone 10, the plurality of heating modules 11*a*, 11*b*, 11*c*, 11*d*, 11*e*, 11*f*, 11*g*, and 11*h* (collectively 11), the media transport path 12, the identification module 13, and the temperature adjustment module 14 of the printing system 100 previously described with respect to FIG. 1.

Referring to FIGS. 2-4, in some examples, the printing system 200 may also include a printing fluid applicator 25 and a second media transport path 22. The printing fluid applicator 25 may apply the printing fluid on respective media 46*a* and 48*b* in the print zone 10 to form the respective images 37*a* and 37*b*. That is the printing fluid applicator 25 may move across media 46*a* and 46*b* in the first direction $d_1$ to form images 37*a* and 37*b* thereon. The first direction $d_1$ and the second direction $d_2$ may be substantially perpendicular to each other. In some examples, the first direction $d_2$ may be a printing fluid applicator scanning direction. In some examples, the printing fluid applicator 25 may include a printhead, plurality of printhead modules, a printbar, a printhead assembly, end the like. For example, the printing fluid applicator 25 may include an inkjet printhead to eject printing fluid onto the media 46*a* and 46*b*. The printing fluid for example, may include ink such as latex ink, ultraviolet radiation curable ink, and the like.

Referring to FIGS. 2-4, in some examples, the second media transport path 22 along which a respective media 46*b* is transported by a media transport assembly 27 (FIG. 2) through the print zone 10 and the heating zone 28. For example, the heating zone 28 may be formed across the media transport path 12 and the second media transport path 22. The heating zone 28, for example, may be between and adjacent to portions of the respective media transport paths 12 and 22 and the heating modules 11. The second media transport path 22 may be substantially parallel to the media transport path 12.

Referring, to FIGS. 2-4, in some examples, the temperature adjustment module 14 may independently adjust a respective target curing temperature of each one of the hasting modules 11*a*, 11*b*, 11*e*, 11*d*, 11*e*, 11*f*, 11*g* and 11*h* based on each one of the type of the respective media 46*a* and 46*h* and the respective densities of the portions 39*a*, 39*b*, 39*c*, 39*d*, 39*e*, 39*f*, 39*g*, 39*h*, 39*i*, 39*j*, 39*k*, 39*l*, 39*m*, 39*n*, 39*o*, and 39*p* of the images 37*a* and 37*b* identified by the identification module 13. For example, the image 37*a* and 37*b* may be divided into a number of image portions 39*a*, . . . , 39*o*, and 39*p* in which the identification module 13 may identify respective densities for each one of the portions 39*a*, . . . , 39*o*, and 39*p*. In some examples, the identification module 13 may identify the type of media 48*a* and 46*b* based on user input, sensors, and the like. For example, the identification module 13 may receive input by a user (e.g., data entry) of the type of media 48*a* and 48*b* being used and provide the data entry to the temperature adjustment module 14.

Referring to FIGS. 2-4, in some examples, the temperature adjustment module 14 may independently adjust the respective target curing temperature of each one of the heating modules 11*a*, . . . , 11*g* and 11*h* based on the respective densities of the image portions 39*a*, . . . , 39*o*, and 39*p* corresponding to media regions 49*a*, 49*b*, 49*c*, 49*d*, 49*e*, 49*f*, 49*g*, 49*h*, 49*i*, 49*k*, 49*l*, 49*m*, 49*n*, 49*o* and 49*p* on which the corresponding image portions 39*a*, . . . , 39*o*, and 39*p* are printed. That is, the image portions 39*a*, . . . , 39*o*, and 39*p* may be printed on corresponding media regions 49*a*, . . . , 49*o*, and 49*p* such that the respective target curing temperature for each one of the heating modules 11*a*, . . . , 11*g*, and 11*h* may be adjusted based on the respective density of the image portion 39*a*, . . . , 39*o*, and 39*p* to heal the corresponding media region 49*a*, . . . , 49*o* and 49*p*.

In some examples, the target curing temperature for a respective heating module 11*a*, . . . , 11*g* and 11*h* may be selectively adjusted based of the density of a respective image portion 39*a*, . . . , 39*o*, and 39*p* proximate to it to be heated. For example, certain image portions 39*b*, 39*c*, and 39*g* have a higher image density than other image portions 39*a*, 39*d*-39*f* and 39*h*-39*p*. Thus, the heating modules 11*b*, 11*e*, and 11*g* that correspond to and heat the respective media regions 49*b*, 49*c*, and 49*g* on which the higher density image portions 39*b*, 39*c*, and 39*g* are printed may be adjusted to a higher target curing temperature.

Additionally, the heating modules 11*a*, 11*d*-11*f* and 11*h* that correspond to and heat the respective media regions 49*a*, 49*d*-49*f*, and 49*h*-49*p* on which the lower density image portions 39*a*, 39*d*-39*f*, and 39*h*-39*p* are printed may be adjusted to a lower target curing temperature. In some examples, the respective heating modules 11*a*, . . . , 11*g*, and 11*h* may be activated at a time when the respective media region 49*a*, . . . , 49*o*, and 49*p* having the respective image portion 39*a*, . . . , 39*o*, and 39*p* thereon arrives thereat. For example, a determination of the time to activate the respective heating module 11*a*, . . . , 11*g*, and 11*h* may be based on a distance of the respective, media portion 39*a*, . . . , 39*o* and 30*p* from the respective heating module 11*a*, . . . , 11*g*, and 11*h* and a linear speed of the respective media 46*a* and 46*b*, Thus, curing defects to the printed image 37*a* and 37*b* on the media 47*a* and 47*b* due to underexposure and overexposure of heat by the heating modules 11*a*, . . . , 11*g* and 11*h* may be reduced.

Figure 5:
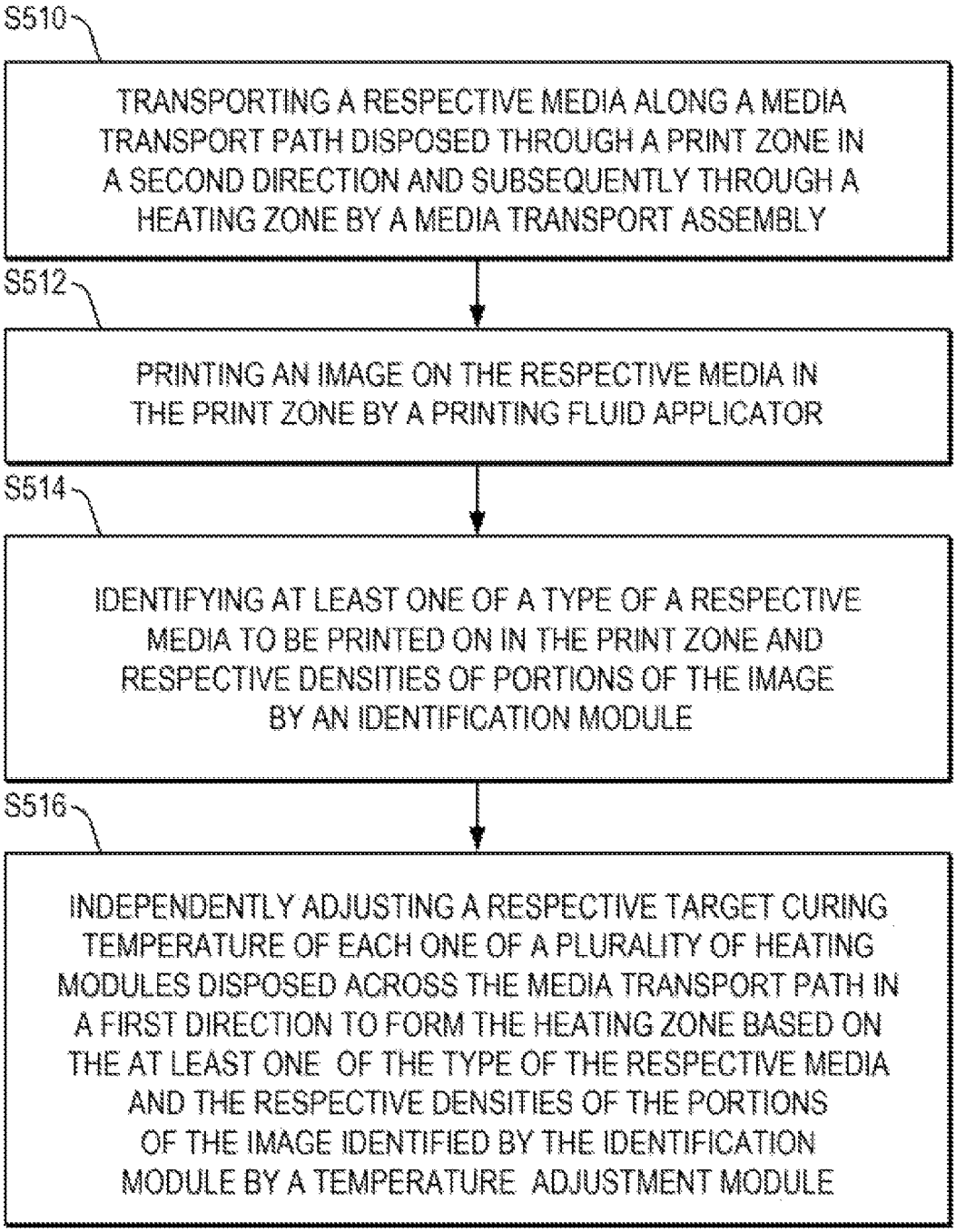
FIG. 5 is a flowchart illustrating a method of heating a print zone disposed between a printing fluid applicator and a media support device of a printing system according to an example.

FIG. 5 is a flowchart illustrating a method of printing of a printing system according to an example. In some examples, the modules and/or assemblies implementing the method may be those described in relation to the printing systems 100 and 200 of FIGS. 1-4. Referring to FIG. 5, in block S510, a respective media is transported along a media transport path disposed through a print zone in a second direction and subsequently through a heating zone by a media transport assembly. In block S512, an image is printed on the respective media in the print zone by a printing fluid applicator. In block S514, at least one of a type of a respective media to be printed on in the print zone and respective densities of portions of the image is identified by an identification module. In some examples, identifying the respective densities of the portions of the image from image data prior to printing the image on the respective media. For example, the image data may be stored in memory. Alternatively, identifying the respective densities of the portions of the image may be performed after printing the image on the respective media.

In block S516 a respective target curing temperature of each one of a plurality of heating modules disposed across the media transport path in a first direction to form the heating zone is independently adjusted based on the at least one of the type of the respective media and the respective densities of the portions of the image identified by the identification module by a temperature adjustment module. For example, independently adjusting the respective target curing temperature of each one of the heating modules may be based on the respective densities of the portions of the image-corresponding to the regions of the respective media on which the respective portions of the image are printed.

That is, a respective target curing temperature of a respective heating module may be increased to correspond with an increased density of the portion of the image to be printed on a corresponding region of the respective media to be heated lay the heating module. Alternatively, the respective target curing temperature of the respective heating module may be decreased to correspond with a decreased density of the image portion to be printed on the corresponding media region to be heated by the heating module. The method may also include transporting; a respective media along a second media transport path disposed through the print zone and the heating zone such that the second media transport path is substantially parallel to the media transport path.

Figure 6:
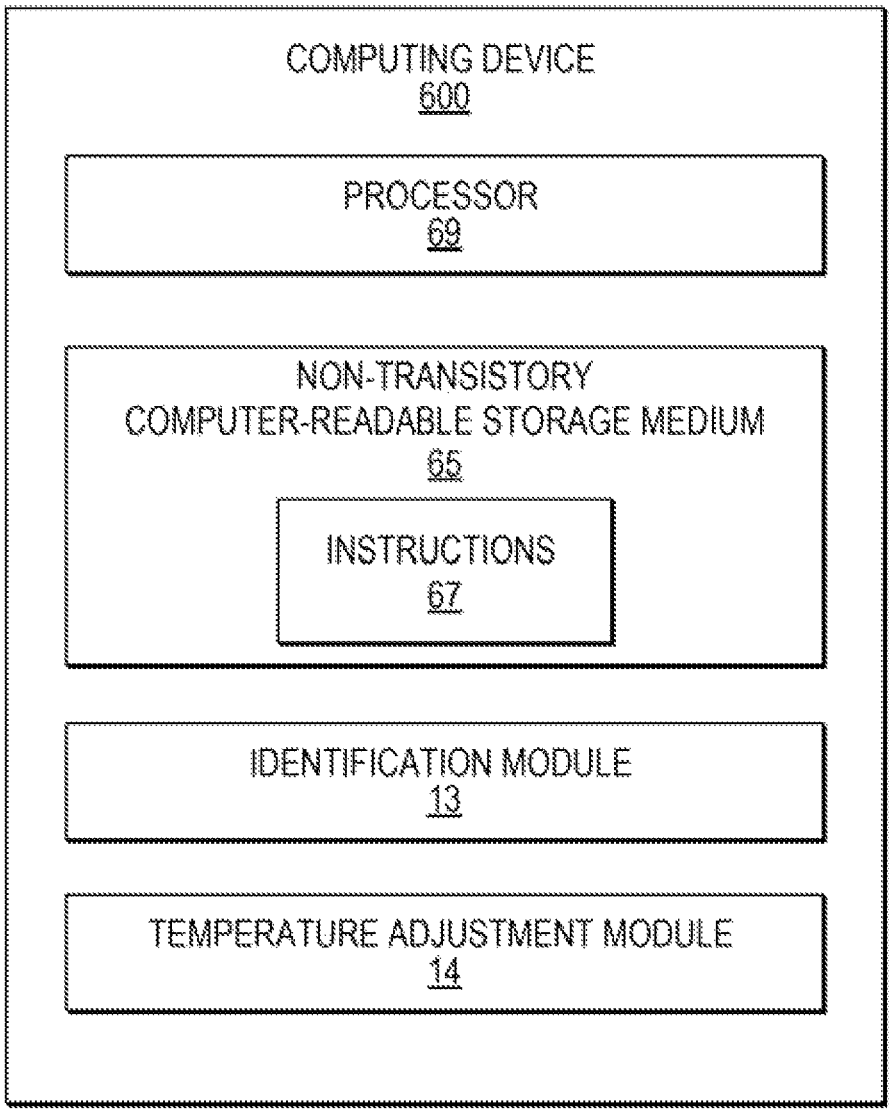
FIG. 6 is a block diagram illustrating a computing device such as a printing system; including a processor and a non-transitory, computer-readable storage medium to store instructions to operate a printing system to heat a print zone disposed between a printing fluid applicator and a media support device thereof according to an example.

FIG. 6 is a block diagram illustrating a computing device such as a printing system including a processor and a non-transitory, computer-readable storage-medium to store instructions to operate the printing system to heat a print zone disposed between a printing fluid applicator and a media support device thereof according to an example. Referring to FIG. 6, in some examples, the non-transitory computer-readable storage medium 66 may be included in a computing device 600 such as a printing system including an identification module 13 and a temperature adjustment module 14. In some examples, the non-transitory, computer-readable storage medium 65 may be implemented in whole or in part as instructions 67 such as computer-implemented instructions stored in the computing device locally or remotely, for example, in a server or a host computing device 600 considered herein to be part of the printing system.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM). Referring to FIG. 6, examples of storage devices include, but are not limited to, hard disk drives, compact disc drives, digital versatile disc drives, optical drives, and flash memory devices. In some examples, the non-transitory, computer-readable storage medium 85 may even be paper or another suitable medium upon which the instructions 87 are printed, as the instructions can be electronically captured, via, for instance, apical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 600 such as a printing system to heat a print zone disposed between a printing fluid applicator and a media support device thereof an example, the non-transitory, computer-readable storage medium 85 can be accessed by the processor 89.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may foe rearranged relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept it should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include;" "have" and their conjugates, shall mean, when used in the disclosure and/or claims, "including but not necessarily limited to."

It is noted that some of the above described examples may include structure, acts or details of structures and acts that may not be essential to the general inventive concept, and which are described for illustrate purposes. Structure and acts described herein are replaceable by equivalents, which perform the same function, even if the structure or acts are different, as known in the art. Therefore, the scope of the general inventive concept is limited only by the elements and limitations as used to the claims.

What is claimed is:

1. A printing system, comprising:

a print zone;

a plurality of heating modules disposed across a heating zone in a first direction, each of the plurality of heating modules to selectively provide heat having a respective target curing temperature in the heating zone;

first and second media transport paths disposed through the print zone and the heating zone in a second direction, a first media transportable along the first media transport path by a media transport assembly, and a second media transportable by the media transport assembly along the second media transport path that is parallel to the first media transport path; and a processor to:

identify a first type of the first media and respective densities of portions of a first image prior to printing the first image on the first media;

independently adjust respective target curing temperatures of a first subset of the heating modules based on the identified first type of the first media and the respective densities of the portions of the first image;

identify a second type of the second media and respective densities of portions of a second image prior to printing the second image on the second media;

independently adjust respective target curing temperatures of a second subset of the heating modules based on the identified second type of the second media and the respective densities of the portions of the second image; and cause simultaneous heating of the first subset of the heating modules and the second subset of the heating modules.

2. The printing system of claim 1, wherein the processor is to independently adjust the respective target curing temperatures of the first subset of the heating modules based on the identified first type of the first media and the respective densities of the portions of the first image corresponding to regions of the first media on which the corresponding portions of the first image are to be printed.

3. The printing system of claim 1, wherein the processor is to:

cause printing of the portions of the first image on the first media with the heating modules of the first subset of the heating modules adjusted according to the respective target curing temperatures of the first subset of the heating modules.

4. The printing system of claim 1, wherein the first direction and the second direction are substantially perpendicular to each other.

5. The printing system of claim 1, further comprising;

a printing fluid applicator to apply a printing fluid on the first media and the second media in the print zone to form the first image and the second image, the printing fluid applicator to move across the print zone across the first media and the second media in the first direction.

6. The printing system of claim 1, wherein the heating zone is formed across the first media transport path and the second media transport path.

7. The printing system of claim 1, wherein the processor is to independently adjust the respective target curing temperatures of the first subset of the heating modules by:

adjusting the target curing temperature of a first heating module to a first temperature in response to identifying a first density of a first portion of the first image from image data prior to printing the first image on the first media; and adjusting the target curing temperature of a second heating module to a second temperature in response to identifying a second density of a second portion of the first image from the image data prior to printing the first image on the first media, the second temperature different from the first temperature, and the second density different from the first density.

8. The printing system of claim 1, further comprising;

a non-transitory storage medium storing instructions executable on the processor to perform the identifying of the first type of the first media and the respective densities of the portions of the first image, the adjusting of the respective target curing temperatures of the first subset of the heating modules, the identifying of the second type of the second media and the respective densities of the portions of the second image, and the adjusting of the respective target curing temperatures of the second subset of the heating modules.

9. The printing system of claim 1, wherein heating modules of the first subset of the heating modules are disposed over the first media in the heating zone, and heating modules of the second subset of the heating modules are disposed over the second media in the heating zone.

10. A method of printing of a printing system, the method comprising:

transporting a first media along a first media transport path disposed through a print zone in a second direction and subsequently through a heating zone by a media transport assembly;

transporting a second media along a second media transport path disposed through the print zone and the heating zone such that the second media transport path is parallel to the first media transport path;

printing a first image on the first media and a second image on the second media in the print zone by a printing fluid applicator;

identifying a first type of the first media and respective densities of portions of the first image from first image data prior to printing of the first image on the first media;

independently adjusting respective target curing temperatures of a first subset of heating modules disposed across the first media transport path in a first direction to form a first part of the heating zone based on the identified first type of the first media and the respective densities of the portions of the first image;

identifying a second type of the second media and respective densities of portions of the second image from second image data prior to printing of the second image on the second media;

independently adjusting respective target curing temperatures of a second subset of heating modules disposed across the second media transport path in the first direction to form a second part of the heating zone based on the identified second type of the second media and the respective densities of the portions of the second image; and simultaneously heat the first subset of heating modules and the second subset of heating modules according to the respective target curing temperatures of the first and second subsets of heating modules.

11. The method of claim 10, further comprising printing the first image on the first media with the first subset of heating modules adjusted according to the respective target curing temperatures of the first subset of heating modules.

12. The method of claim 11, wherein the independently adjusting the respective target curing temperatures of the first subset of heating modules is based on the respective densities of the portions of the first image corresponding to regions of the first media on which the respective portions of the first image are to be printed.

13. The method of claim 10, further comprising increasing a respective target curing temperature of a respective heating module in response to an increased density of a portion of the first image to be printed on a corresponding region of the first media to be heated by the respective heating module.

14. The method of claim 10, wherein independently adjusting the respective target curing temperatures of the first subset of heating modules comprises:

adjusting the target curing temperature of a first heating module to a first temperature in response to identifying a first density of a first portion of the first image from the first image data prior to printing the first image on the first media; and adjusting the target curing temperature of a second heating module to a second temperature in response to identifying a second density of a second portion of the first image from the first image data prior to printing the first image on the first media, the second temperature different from the first temperature, and the second density different from the first density.

15. The method of claim 10, wherein heating modules of the first subset of heating modules are disposed over the first media in the heating zone, and heating modules of the second subset of heating modules are disposed over the second media in the heating zone.

16. A non-transitory computer-readable storage medium having computer executable instructions stored thereon to operate a printing system, the instructions are executable on a processor to:

identify a first type of a first media and respective densities of portions of a first image from first image data prior to printing of the first image on the first media in a print zone;

identify a second type of a second media and respective densities of portions of a second image from second image data prior to printing of the second image on the second media in the print zone, wherein the first and second medias are transported along parallel transport paths;

independently adjust respective target curing temperatures of a first subset of heating modules disposed across the first media transport path to form a first part of a heating zone, the adjusting based on the identified first type of the first media and the respective densities of the portions of the first image;

independently adjust respective target curing temperatures of a second subset of heating modules disposed across the second media transport path to form a second part of the heating zone, based on the identified second type of the second media and the respective densities of the portions of the second image; and cause simultaneous heating of the first subset of heating modules and the second subset of heating modules that are over the respective first media and the second media.

17. The non-transitory computer-readable storage medium of claim 16, wherein the instructions are executable on the processor to:

cause printing of the portions of the first image on the first media with the first subset heating modules adjusted according to the respective target curing temperatures of the first subset of heating modules.

18. The non-transitory computer-readable storage medium of claim 16, wherein independently adjusting the respective target curing temperatures of the first subset of heating modules comprises:

adjusting the target curing temperature of a first heating module to a first temperature in response to identifying a first density of a first portion of the first image from the first image data prior to printing the first image on the media; and adjusting the target curing temperature of a second heating module to a second temperature in response to identifying a second density of a second portion of the second image from the second image data prior to printing the second image on the second media, the second temperature different from the first temperature, and the second density different from the first density.

* * * * *